US005816221A

United States Patent [19]

Krueger

[11] Patent Number: 5,816,221

[45] Date of Patent: Oct. 6, 1998

[54] FUEL INJECTED ROPE-START ENGINE SYSTEM WITHOUT BATTERY

[75] Inventor: William R. Krueger, New Berlin, Wis.

[73] Assignee: Outboard Marine Corporation, Waukegan, Ill.

[21] Appl. No.: 934,879

[22] Filed: Sep. 22, 1997

[51] Int. Cl.[6] ..... F02N 3/02; F02D 41/06

[52] U.S. Cl. ..... 123/491; 123/149 D; 123/179.29; 123/185.3

[58] Field of Search ..... 123/149 A, 149 D, 123/179.1, 179.16, 179.28, 179.29, 185.2, 185.3, 417, 424, 478, 480, 491

[56] References Cited

U.S. PATENT DOCUMENTS

| | | | |
|---|---|---|---|
| 4,329,951 | 5/1982 | Seilly | 123/179.17 |
| 4,515,118 | 5/1985 | Haubner et al. | 123/417 X |
| 4,901,704 | 2/1990 | Safranek | 123/149 D X |
| 5,161,496 | 11/1992 | Matsushima et al. | 123/185.3 |
| 5,172,675 | 12/1992 | Kurosu et al. | 123/149 A X |
| 5,419,291 | 5/1995 | Kimata et al. | 123/179.16 |
| 5,479,909 | 1/1996 | Blakeslee et al. | 123/491 |

*Primary Examiner*—Tony M. Argenbright
*Attorney, Agent, or Firm*—Jones, Day, Reavis & Pogue

[57] ABSTRACT

A system that provides rope-start capability on a fuel injected engine without the need of a battery. The system provides power to run an electronic fuel injection and the ignition directly from the alternator.

12 Claims, 1 Drawing Sheet

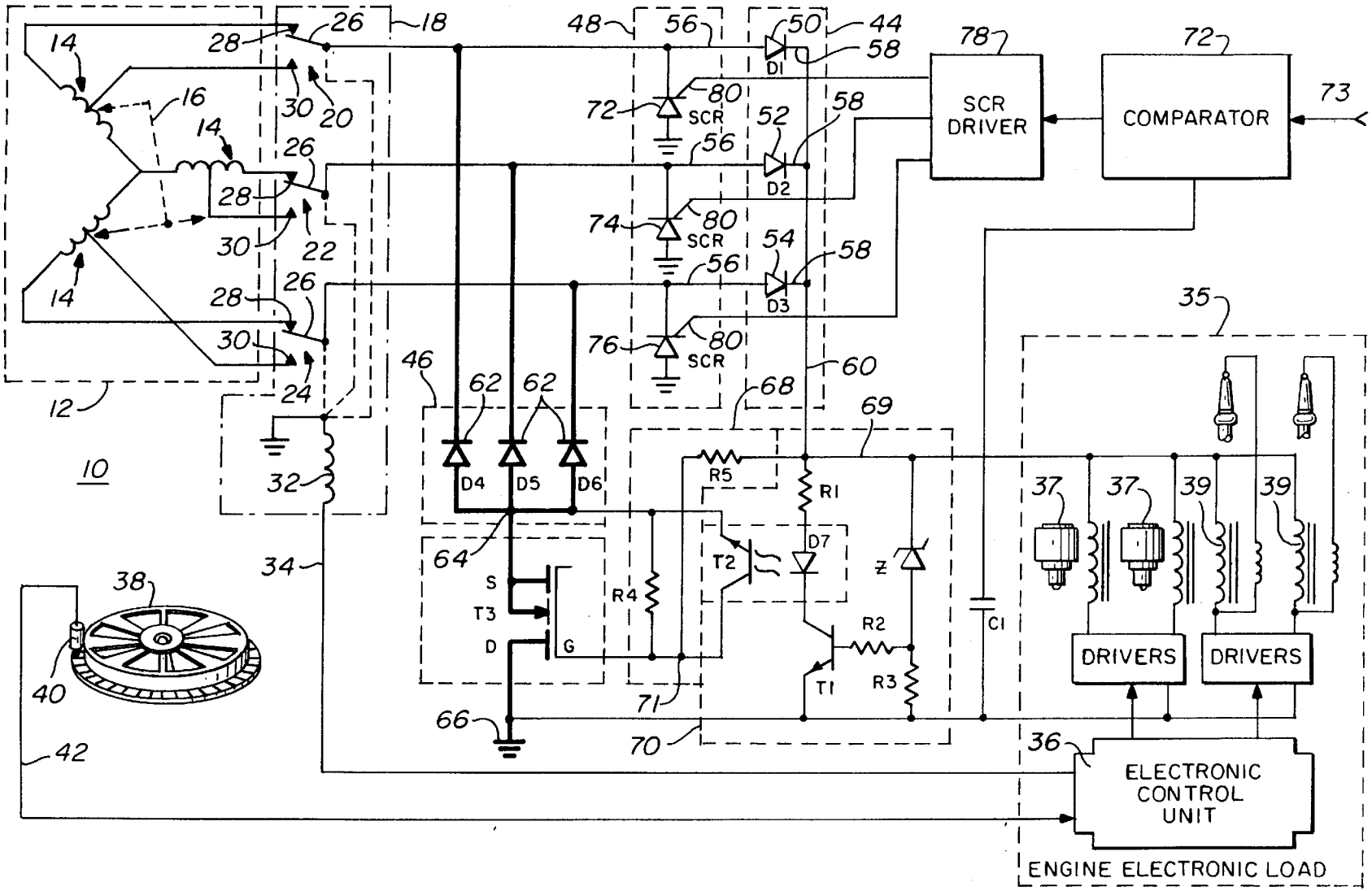
COMPARATOR
SCR DRIVER
DRIVERS
DRIVERS
ELECTRONIC CONTROL UNIT
ENGINE ELECTRONIC LOAD
SCR
SCR
SCR
D1
D2
D3
D4
D5
D6
D7
R1
R2
R3
R4
R5
T1
T2
T3
Z
C1
S
D
G

FUEL INJECTED ROPE-START ENGINE SYSTEM WITHOUT BATTERY

BACKGROUND OF THE INVENTION

1. Field of the Invention

The invention relates in general to a fuel injected engine that can be started with a rope without the need of a battery and having an alternator with a low speed winding to provide the best speed versus output characteristics for the injectors and ignition at rope-start speeds and a high speed winding that provides the best speed versus output characteristics at normal running speeds.

2. Description of Related Art Including Information Disclosed Under 37 CFR 1.97 and 1.98

Normally, electronic fuel injection requires a battery to start the engine. This is because a significant amount of energy is needed to power the electronic fuel injection and the ignition while the engine is being started and there is little or no output from standard alternators at starting speeds so the energy must come from the battery.

It would be advantageous to have rope-start capability of a fuel injected engine without the need of a battery wherein the system could provide power to run the electronic fuel injection and the ignition directly from the alternator. This is desirable because the need for a battery on smaller and more portable engines is prohibitive.

The present invention discloses a system that provides rope-start capability on a fuel injected engine without the need of a battery and which provides power to run the electronic fuel injection and the ignition directly from the alternator. The invention is not limited to any specific engine and may be applied to a wide range of engines including snowmobiles, motorcycles, and personal watercraft engines.

SUMMARY OF THE INVENTION

The no-battery, rope-start alternator/regulator system of the present invention consists of a three-phase permanent magnet flywheel and custom stator assembly and a specially designed regulator. The system provides energy for a standard unmodified electronic control unit, electronic fuel injectors, ignition system, and an optional 12-volt output to power user accessories when the engine is running.

The alternator consists of a permanent magnet flywheel and a stator that has three-phase low speed windings to provide the best speed versus output characteristics for the injectors and ignition at cranking or rope-start speeds and three-phase high speed windings that provide the best speed versus output characteristics at normal running speeds. A relay controlled by the engine control unit (ECU) can switch between the full winding and the high speed winding of each leg of the alternator.

During starting operations, a first circuit applies the positive voltage pulses from the starting winding to one side of a capacitor and a second circuit applies the negative pulses from the starting windings of the alternator to the other side of the capacitor. Once the capacitor has been charged to a voltage sufficient to operate the power consumption units such as the fuel injectors, the ignition circuit, and the electronic control unit, the second circuit is disabled and a third circuit is coupled in parallel with the disabled second circuit for providing the negative pulses of the alternator to the other side of the capacitor and serves as a voltage regulator circuit during normal engine run operations.

Thus, it is an object of the present invention to provide a no-battery, rope-start alternator/regulator system for a fuel injected engine.

It is still another object of the present invention to provide an alternator with start windings for charging a capacitor sufficiently during start-up to operate the engine power consumption units such as the fuel injectors, the ignition system, and the electronic control unit and a second set of winding is for providing a voltage for normal engine run operations.

It is still another object of the present invention to provide a voltage regulator circuit for regulating the amount of voltage to which a capacitor is charged during normal engine run operations.

Thus, the present invention relates to a batteryless fuel injected internal combustion engine having a rope-start operation and a normal run operation. Electrical power consumption units on the engine include an ignition system, a fuel injection system, and an engine control unit. An alternator having a rotor for rotation during both the rope-start operation and the normal run operation generates positive and negative pulses of voltage. A charging capacitor is coupled to the power consumption units and has first and second opposed plates for storing voltage from the alternator sufficient to operate the power consumption units. First and second circuits are coupled between the alternator and the charging capacitor. The first circuit is coupled to the first plate of the charging capacitor for charging the capacitor with the positive voltage pulses during both the rope-start operation and the normal run operation. The second circuit is coupled to the second capacitor plate for charging the capacitor with the negative voltage pulses from the alternator only during the rope-start operation. A third circuit is coupled in parallel with the second circuit to the second plate of the capacitor for charging the capacitor with the negative voltage pulses that can be regulated only during the normal run operation.

BRIEF DESCRIPTION OF THE DRAWINGS

These and other features of the present invention will be more fully disclosed when taken in conjunction with the following DETAILED DESCRIPTION OF THE PREFERRED EMBODIMENT in which like numerals represent like elements and in which the FIGURE is a schematic representation of the electronic system of the present invention.

DETAILED DESCRIPTION OF THE PREFERRED EMBODIMENT

The novel batteryless fuel injected internal combustion engine of the present invention is disclosed in the FIGURE. The engine 10 includes an alternator 12 having a rotor 38 for rotation during the rope-start operation and the normal run operation of the engine to generate positive and negative pulses of voltage. The manner in which the permanent magnet alternator generates voltage is, of course, old and well known in the art. A charging capacitor C1 is coupled to the alternator 12 as well as to power consumption units 35 including an electronic control unit (ECU), electronic fuel injectors 37, and ignition coils 39. The charging capacitor C1 has first and second opposed plates well known in the art for storing voltage sufficient to operate the power consumption units 35. A first circuit 44 and a second circuit 46 are coupled between the alternator 12 and the charging capacitor C1. The first circuit 44 is coupled to the first plate of the capacitor for charging the capacitor C1 with positive voltage pulses during both the rope-start operation and the normal run operation of the engine. The second circuit 46 is coupled through ground 66 to the second plate of the capacitor C1 for charging the capacitor C1 with the negative voltage pulses only during the rope-start operation. A third circuit 48 is also coupled to the second plate of the capacitor and to the alternator 12 in parallel with second circuit 46 for charging the capacitor C1 with the negative voltage pulses only during the normal run operation.

The alternator 12 further includes special three-phase windings 14 that provide a full winding tap for providing a first optimum voltage during the rope-start operation of the engine and a partial winding tap 16 for providing a second different optimum voltage during the normal run operation of the engine.

A three-pole, double-position relay 18 has first contact 28 on each pole 20, 22, and 24 of the relay 18 connected to a respective one of the full winding taps 14 in each phase winding for receiving the first optimum voltage. A second contact 30 on each pole 20, 22, and 24 of the relay 18 is connected to a respective one of the partial winding taps 16 in each phase winding for receiving a second optimum voltage. A contact arm 26 on each pole 20, 22, and 24 of relay 18 is selectively connected to a respective one of either of the first relay contact 28 or the second relay contact 30 for receiving both the positive and negative pulses of the first optimum voltage during rope-start operation and both positive and negative pulses of the second optimum voltage during the normal run operation of the engine. A relay coil 32 is coupled on line 34 to the ECU 36 which causes the contact arm 26 of the relay to selectively move between the first contact 28 and the second contact 30.

The first circuit 44 comprises a first set of first, second, and third diodes 50, 52, and 54 (D1, D2, D3). Each of the diodes 50, 52, and 54 has a positive polarity terminal 56 connected to a respective one of each relay contact arm 26 and a negative polarity terminal 58 that is coupled to one side of the capacitor for providing the first and second optimum voltages to charge the capacitor C1.

The second circuit 46 comprises a second set of first, second, and third diodes D4, D5, and D6, each having a negative polarity terminal 62 coupled to a respective one of each relay contact arm 26 and a positive polarity terminal 64. Switch means, in the form of transistor T3, is coupled between each said positive polarity terminal 64 of the second set of diodes D4, D5, and D6 and the other side of the capacitor C1 through ground 66.

A switch activating means, resistors R4 and R5, are coupled to the capacitor C1 and the switch means T3 for turning the switch means T3 ON during the rope-start operation. Switch deactivating means 70, including transistor T1, phototransistor T2, and zener diode Z, are coupled to the capacitor C1 and to the switch means T3 for turning the switch means OFF when sufficient voltage is stored by the capacitor C1 to enable the voltage regulator 72 to operate.

The third circuit 48 includes first, second, and third silicon controlled rectifiers (SCRs) 72, 74, and 76. Each of them has a first negative polarity terminal coupled to the positive polarity input 56 of the corresponding one of the first set of first, second, and third diodes 50, 52, and 54. They also have a second positive polarity terminal connected to the other side of the capacitor C1 through ground terminal 66. The voltage regulator 72 is coupled to a driver 78 whose output is coupled to the gate terminals 80 on the respective silicon controlled rectifiers 72, 74, and 76 for receiving signals from the voltage regulator 72 to cause the silicon controlled rectifiers 72, 74, and 76 to have a first electrically conductive state for enabling charging of the capacitor C1 during normal run operation through both the silicon controlled rectifiers 72, 74, and 76 and the first set of diodes 50, 52, and 54. The comparator 72 also causes the silicon controlled rectifiers 72, 74, and 76 to have a second non-conducting electrical state that opens the negative conduction path and thus prevents the capacitor C1 from being charged during normal run operation so as to regulate the voltage charge on the capacitor C1.

The transistor T3 has a source, S, connected to the positive polarity terminal 64 of the second set of diodes 46, a drain, D, connected to the other side of the capacitor C1 through ground terminal 66, and a gate, G, coupled to the switch actuating means 70.

The switch activating means 68 includes series connected resistors R4 and R5 coupled between the source, S, of transistor T3, and the power consumption units 35 on line 69. The transistor gate, G, is coupled to the junction 71 of the first and second series connected resistors R4 and R5 such that current flow through the first and second resistors R4 and R5 during rope-start operation of the engine causes a voltage on the gate, G, that turns the transistor T3 ON to enable the capacitor C1 to be charged through the first and second sets of diodes 44 and 46.

When capacitor C1 is charged sufficiently to enable the voltage regulator 72 to operate, a switch deactivating means 70 turns OFF transistor T3. The switch deactivating means 70 includes a photoelectric transistor T2 having an emitter coupled to the source of transistor T3 and a collector coupled to the gate, G, of transistor T3. A trigger circuit includes zener diode, Z, that conducts upon sufficient charging of the capacitor C1 to operate the voltage regulator 72, and a trigger transistor T1 that is operated by the zener diode to cause the photoelectric transistor to conduct when the zener diode conducts thus electrically connecting the source, S, to the gate, G, of transistor T3, thereby turning transistor T3 OFF.

The voltage regulator 72 is a comparator that is connected to the capacitor C1 to receive the capacitor charge voltage. A reference voltage 73, which may be an internal reference voltage or a reference voltage supplied by ECU 36, is used by the comparator 72 and represents a sufficient voltage charge on the capacitor C1 for the comparator 72 to operate. An SCR driver circuit 78 is coupled between the SCR gates 80 and the comparator 72 for turning SCRs 72, 74, and 76 OFF and ON to regulate the capacitor voltage charge sufficient to operate the comparator.

The alternator 12 consists of a standard 150 horsepower flywheel with six ceramic magnets and an 18-pole stator that is specially wound in a tapped three-phase configuration as shown in the FIGURE. As stated earlier, there are taps 16 on the windings of each leg of the three-phase stator that provide a means of changing the effective number of turns wound on each leg. The full winding 14 is used as the low speed winding and provides the best speed versus output characteristics for the injectors 37 and the ignition coils 39 at cranking or rope-start speeds. It is known to those skilled in the art that a greater number of turns will increase the low speed output on this type of alternator. Thus, as stated previously, the relay unit 18 can, at the command from the electronic control unit 36, switch between full winding 14 and the high speed tap 16 of each leg of the alternator. Once the engine has started, the high speed tap, when switched in by the relay 18, configures the alternator winding 16 for the best speed versus output characteristic at the normal running speed thus providing a two-stage alternator that has one winding best suited for starting and one winding best suited for running.

Since the relay 18 is under ECU control and is switched by the ECU 36 at selected programmed speeds, in many cases it is advantageous to have the ECU switch the relay from low to high speed windings at a higher engine speed than it switches from high to low speed windings (hysteresis) so that the relay 18 does not chatter when the engine speed is nearing the switching points. Other means of switching the relay 18 are possible such as from the output of an electronic governor.

The AC output of the alternator 12 is rectified by the first diode circuit 44 and the silicon controlled rectifier circuit 48 and the output from these two is used to charge the storage capacitor C1 on line 60, line 69, and ground terminal 66. C1 is a large value capacitor that is the storage reservoir for alternator energy that is used when needed by the ignition system 39, the fuel injection 37, or the ECU 36.

The amount of voltage across storage capacitor C1 is regulated by the comparator 72, SCR driver 78, and the three SCRs 72, 74, and 76. The comparator 72 compares the voltage at the capacitor C1 on line 69 against the reference voltage 73 which, as stated previously, may be an internal reference or a reference from the ECU 36. If the voltage on the capacitor C1 is below the reference value, the comparator 72 turns ON the SCR driver 78 which causes the SCRs 72, 74, and 76 to conduct thereby allowing a complete path for charging the capacitor C1 from the alternator 12 and diodes 50, 52, and 54. The path is through the diodes 50, 52, and 54 (D1–D3) through capacitor C1 on the positive cycle and to the ground 66 back through the SCRs 72, 74, and 76 to the alternator 12 on the negative cycle. If the comparator 72 finds the voltage at the capacitor C1 above the reference voltage 73, the SCR driver 78 is shut OFF and the alternator 12 no longer has a complete path for current flow and the alternator stops putting energy into the capacitor C1. The end result of this voltage regulation process makes capacitor C1 a voltage regulated energy source for all the electronic loads on the engine.

The second circuit 46 consisting of the three diodes D4, D5, and D6, the transistor T3, and the activation circuit 68 form a self-initiating boot-strap circuit that provides the initial energy to start the regulator 72 when the capacitor C1 is not charged. This capacitor condition exists when the flywheel first begins to turn during rope-start of the engine. Since the SCRs 72, 74, and 76 require energy to turn ON their gates 80 so that power can flow from the alternator 12 to the capacitor C1 and since the capacitor C1 is initially not charged, the energy to start the regulator 72 is provided by the boot-strap circuit as indicated. The function of the boot-strap circuit is to get the capacitor C1 charged enough such that the comparator 72 and the SCR driver circuit 78 can start functioning. The circuit works by paralleling the three SCRs 72, 74, and 76 with diodes D4, D5, and D6 that connect to ground 66, or the other side of capacitor C1. Thus during rope-start operations the alternate path to ground 66 from the other side of capacitor C1 is from the relay contact arm 26 through diodes D4, D5, and D6, transistor T3, and to ground 66. Note that when T3 is turned ON, a complete circuit path is formed to the capacitor C1 and the load unit 35 even though the SCRs 72, 74, and 76 are not turned ON. Turning transistor T3 ON is the first thing that must happen to make the circuit begin charging capacitor C1 when the engine is first beginning to turn over during the rope-start operation. This happens because with transistor T3 initially OFF, the only current path for diodes D4, D5, and D6 is through activating circuit 68 comprising resistors R4 and R5 on its way to ground through the load 35. The voltage drop across R4 is in such a direction as to forward bias T3, the gate is made positive relative to the source for forward bias, thus turning it ON which starts the capacitor charging.

Because R5 is connected to the load 35 at the plus side of the capacitor C1, the forward bias on transistor T3 increases as the capacitive voltage starts to rise turning transistor T3 ON very quickly. This is important because it starts the capacitor C1 charging as soon as possible, thus getting the system working quickly which greatly aids the rope-starting operation. Another way to envision the way the circuit works is to note that the source of transistor T3 is essentially connected to the negative end of the charging circuit and the gate, G, is essentially connected to the positive end, thus providing forward bias for transistor T3.

When the capacitor C1 is charged enough to enable the regulator circuit 72 to function in its normal mode, T3 must be turned OFF. This is done with deactivating circuit 70 which basically consists of zener diode, Z, transistor T1, and the photo-optic coupler T2. When the voltage across the capacitor C1 gets to a level that is sufficiently high to turn ON the zener diode, current flows through resistor R3 turning ON transistor T1. As transistor T1 turns ON, it allows current to flow through D7, the light-emitting diode that is part of the opto coupler transistor T2. This turns ON the photoelectric transistor and, when it is ON, it connects the gate of transistor T3 to its source, thus turning T3 OFF and disabling the circuit.

The system is very flexible and may be used on a wide variety of engines. Some installations on small engines that are easy to crank with a rewind starter (rope-start) may not need the low and high speed windings on the stator because cranking speeds are high enough but the starting and running windings can be one and the same. It is also possible that on some engines the alternator may be of single-phase construction which does not affect the basic way the system functions as just described.

The corresponding structures, materials, acts, and equivalents of all means or step plus function elements in the claims below are intended to include any structure, material, or act for performing the function in combination with other claimed elements as specifically claimed.

I claim:

1. A batteryless fuel injected internal combustion engine having a rope-start operation and a normal run operation and including:

electrical power consumption units including an ignitor system, a fuel injection system, and an engine control unit (ECU);

an alternator having a rotor for rotation during both said rope-start operation and said normal run operation to generate positive and negative pulses of voltage;

a charging capacitor coupled to said alternator and said power consumption units and having first and second opposed plates for storing voltage sufficient to operate said power consumption units;

first and second circuits coupled between said alternator and said charging capacitor, said first circuit being coupled to said first plate for charging said capacitor with said positive voltage pulses during both said rope-start operation and said normal run operation and said second circuit coupled to said second plate for charging said capacitor with said negative voltage pulses only during said rope-start operation; and a third circuit coupled to said second plate of said capacitor for charging said capacitor with said negative voltage pulses only during normal run operation.

2. The engine of claim 1 wherein said alternator further includes:

three-phase windings;

each phase winding having a full winding tap for providing a first optimum voltage during the rope-start operation of said engine; and each phase winding having a partial winding tap for providing a second different optimum voltage during the normal run operation of said engine.

3. The engine of claim 2 further including:

a three-pole, double-position relay;

a first contact on each pole of said relay connected to a respective one of said full winding taps in each phase winding for receiving said first optimum voltage;

a second contact on each pole of said relay connected to a respective one of said partial winding taps in each phase winding for receiving said second optimum voltage;

a contact arm on each pole of said relay for selective connection to a respective one of either of said first and second relay contacts for receiving both positive and negative pulses of said first optimum voltage during rope-start operation and both positive and negative pulses of said second optimum voltage during said normal run operation; and a relay coil coupled to said ECU for causing said contact arm of said relay to selectively move between said first and second contacts.

4. The engine of claim 3 wherein said first circuit means comprises:

a first set of first, second, and third diodes, each having a positive polarity terminal coupled to a respective one of each relay contact arm, and a negative polarity terminal coupled to one side of said capacitor for providing said first and second optimum voltages to said charging capacitor.

5. The engine of claim 4 wherein said third circuit comprises:

first, second, and third silicon controlled rectifiers;

each silicon controlled rectifier having a first negative polarity terminal coupled to the positive polarity input of a corresponding one of said first set of first, second, and third diodes and a second positive polarity terminal connected to the other side of said capacitor;

a voltage regulator coupled to said capacitor and said silicon controlled rectifiers; and a gate terminal on each said silicon controlled rectifier for receiving signals from said voltage regulator to cause said silicon controlled rectifiers to have a first electrically conductive state for enabling charging of said capacitor during normal run operation through both said silicon controlled rectifiers and said first set of diodes and a second non-conducting electrical state that prevents said capacitor from being charged during normal run operation so as to regulate the voltage charge on said capacitor.

6. The engine of claim 5 wherein said second circuit comprises:

a second set of first, second, and third diodes, each having a negative polarity terminal coupled to a respective one of each relay contact arm and a positive polarity terminal;

switch means coupled between each said positive polarity terminal of said second set of diodes and the other side of said capacitor;

switch activating means coupled to said capacitor and said switch means for turning said switch means ON during said rope-start position; and switch deactivating means coupled to said capacitor and said switch means for turning said switch OFF when sufficient voltage is stored by said capacitor to enable said voltage regulator to operate.

7. The engine of claim 6 wherein said switch means is a transistor having a source connected to said positive polarity terminal of said second set of diodes, a drain connected to said other side of said capacitor, and a gate coupled to said switch activating means.

8. The engine of claim 7 wherein said switch activating means includes:

first and second series connected resistors coupled between said transistor source and said power consumption units; and said transistor gate being coupled to the junction of said first and second series connected resistors such that current flow through said first and second resistors during rope-start operation of said engine causes a voltage on said gate that turns said transistor ON to enable said capacitor to be charged through the first and second sets of diodes.

9. The engine of claim 8 wherein said switch deactivating means includes:

a photoelectric transistor having an emitter and a collector coupled across said first transistor source and gate; and a trigger circuit coupled between said photoelectric transistor and said capacitor for causing said photoelectric transistor to conduct when said capacitor is sufficiently charged to enable said voltage regulator to operate so as to electrically connect the source and the gate of said first transistor thereby turning said transistor OFF.

10. The engine of claim 9 wherein said trigger circuit includes:

a zener diode that conducts upon said sufficient charging of said capacitor; and a trigger transistor activated by conduction of said zener diode to cause said photoelectric transistor to conduct when said zener diode conducts.

11. The engine of claim 6 wherein said voltage regulator includes:

a comparator;

said comparator being connected to said capacitor for receiving said capacitor voltage charge;

a reference voltage used by said comparator and representing a sufficient voltage charge on said capacitor for said comparator to operate; and a silicon controlled rectifier driver circuit coupled between said silicon controlled rectifier gates and said comparator for turning said silicon controlled rectifiers OFF and ON to regulate said capacitor voltage charge sufficient to operate said comparator.

12. The engine of claim 11 wherein said reference voltage is developed exterior of said comparator.

* * * * *